US006804852B1

(12) United States Patent
Hay

(10) Patent No.: US 6,804,852 B1
(45) Date of Patent: Oct. 19, 2004

(54) BRUSH

(75) Inventor: Donald Espie Hay, Wanchai (HK)

(73) Assignee: Hayco Manufacturing Ltd. (HK)

( * ) Notice: Subject to any disclaimer, the term of this patent is extended or adjusted under 35 U.S.C. 154(b) by 171 days.

(21) Appl. No.: 09/686,396

(22) Filed: Oct. 9, 2000

(51) Int. Cl.[7] ..... A46B 9/02; A46B 7/04

(52) U.S. Cl. ..... 15/160; 15/143.1; 15/145; 15/164; 15/176.1; 15/176.6

(58) Field of Search ..... 15/106, 143.1, 15/145, 159.1, 160, 164, 176.1–176.3, 176.6, 167.1, 167.2; D4/119, 120, 127, 128, 130, 132, 133, 104, 110–112

(56) References Cited

U.S. PATENT DOCUMENTS

| | | | | | |
|---|---|---|---|---|---|
| 188,242 | A | * | 3/1877 | Goldsmith | 15/143.1 |
| 750,357 | A | * | 1/1904 | Gibbons | 15/160 |
| 879,754 | A | * | 2/1908 | Featherstone | 15/164 |
| 1,660,318 | A | * | 2/1928 | Anderson | 15/164 |
| 1,848,868 | A | * | 3/1932 | Churchill | 15/164 |
| 2,124,647 | A | * | 7/1938 | Bauler | 15/167.1 |
| 2,242,004 | A | * | 5/1941 | Kapinos | 15/106 |
| D242,963 | S | * | 1/1977 | Glasberg | D4/128 |
| 5,878,459 | A | * | 3/1999 | McParland | 15/160 X |

FOREIGN PATENT DOCUMENTS

| | | | | |
|---|---|---|---|---|
| AU | 11735 | * | 3/1933 | 15/106 |
| CH | 335822 | * | 3/1959 | 15/143.1 |
| DE | 687807 | * | 2/1940 | 15/167.2 |
| DE | 1231664 | * | 1/1967 | 15/160 |
| EP | 329938 | * | 1/1989 | 15/160 |
| EP | 375634 | * | 6/1990 | 15/160 |
| FR | 472405 | * | 12/1914 | 15/176.1 |
| FR | 1386095 | * | 1/1965 | 15/143.1 |
| GB | 2265822 | * | 10/1993 | 15/160 |

* cited by examiner

*Primary Examiner*—Mark Spisich
(74) *Attorney, Agent, or Firm*—Renner, Kenner, Greive, Bobak, Taylor & Weber

(57) ABSTRACT

A brush for cleaning purposes comprises an elongate block (8), a spigot (10) extending laterally from the block (8), a handle (2) secured to the spigot (10), a plurality of outwardly-extending bristles (6) secured to the block (8), including bristles (6) on a region of block (8) adjacent the spigot, which bristles (6) extend in the direction of the spigot (10) towards the handle (2).

4 Claims, 5 Drawing Sheets

BRUSH

FIELD OF INVENTION

This invention relates to a brush for cleaning purposes and particularly but not exclusively to a brush which is suited to cleaning toilet bowls, and to a method of manufacture thereof.

BACKGROUND OF INVENTION

A variety of brushes exist designed for use in different types of cleaning. A conventional deign of brush comprises a base or block on which bristles are attached and from which a handle extends. The base is provided with a plurality of blind recesses each receiving a clump of bristles. In this type of design, the base and the handle are usually formed of a unitary piece of material such as plastics. The advantage of this arrangement is that the total costs of manufacturing can be kept low.

A traditional toilet brush typically uses a generally cylindrical base or block having a handle extending therefrom at one end. Bristles are attached around the surface of the base and at the end facing away from the handle. Such a brush can be manufactured relatively easily. During insertion of the bristles into the recess the brush can be securely held by the handle. However, a problem with this kind of brush is that it is not a convenient shape for cleaning up under the difficult to reach regions of the rim of a toilet bowl.

It is thus an object of the present invention to provide a brush and a method of manufacturing such a brush which can clean the underside of the lip arranged on the upper end of a toilet bowl, or at least to provide a useful alternative to the public.

SUMMARY OF THE INVENTION

According to a first aspect of the invention provides a brush for cleaning purposes comprising an elongate block, a spigot extending laterally from the block; a handle secured to the spigot, and a plurality of outwardly-extending bristles secured to the block, including bristles on a region of block adjacent the spigot which bristles extend generally in the direction of the spigot towards the handle.

This arrangement, and in particular the arrangement of bristles extending generally in the same direction as the spigot is particularly effective in cleaning of confined spaces such as under the rim of a toilet.

The block is preferably of overall cylindrical form having curved ends of generally part-spherical or hemispherical form. The spigot is preferably formed unitarily with the block, for ease of manufacture. The handle is preferably formed with a recess within which the spigot is fitted, whilst a pin is used to secure the handle and spigot.

In a further aspect the invention resides in a method of manufacture of a brush having a block of elongate form defining a plurality of bristle-receiving recesses therein, and a spigot extending laterally from the block, comprising the steps of: i) gripping the spigot in a movably-mounted clamp; ii) sequentially aligning each recess with a bristle-inserting tool and forcing a clump of bristles into that recess; and iii) securing a handle to the spigot. The clamp is preferably mounted to allow rotation about two perpendicular axes.

The clamp is adapted to hold the block in a manner whereby at least half the block is exposed. Step ii) of the method is carried out with the block held in a first orientation, followed by a second orientation opposite to said first orientation. The clamp preferably comprises a scissor-like structure movable between an open position in which the spigot can be fitted or removed from the clamp and a closed position in which the spigot is firmly gripped therein.

BRIEF DESCRIPTION OF DRAWINGS

The invention will now be described, by way of example only, with reference to the accompanying drawings, in which.

DETAILED DESCRIPTION OF THE PREFERRED EMBODIMENT

Figure 1:
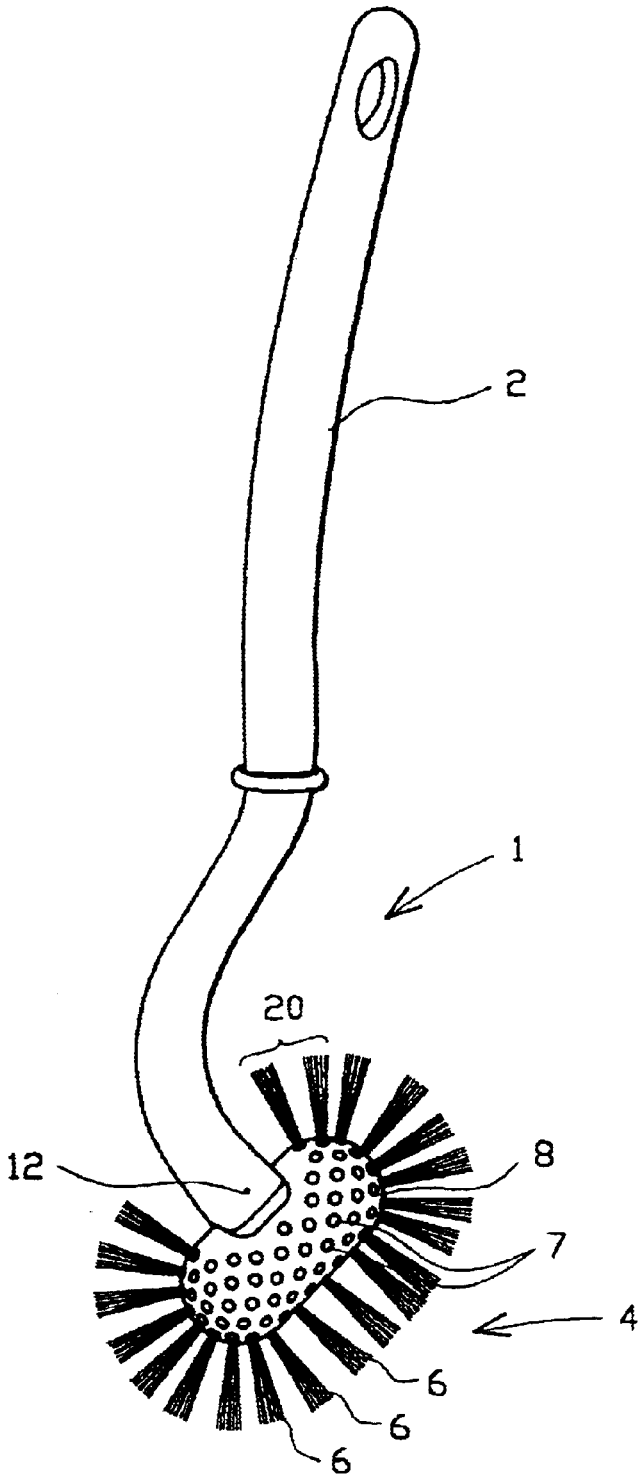
FIG. 1 is a perspective view showing a brush according to the present invention.
Figure 2:
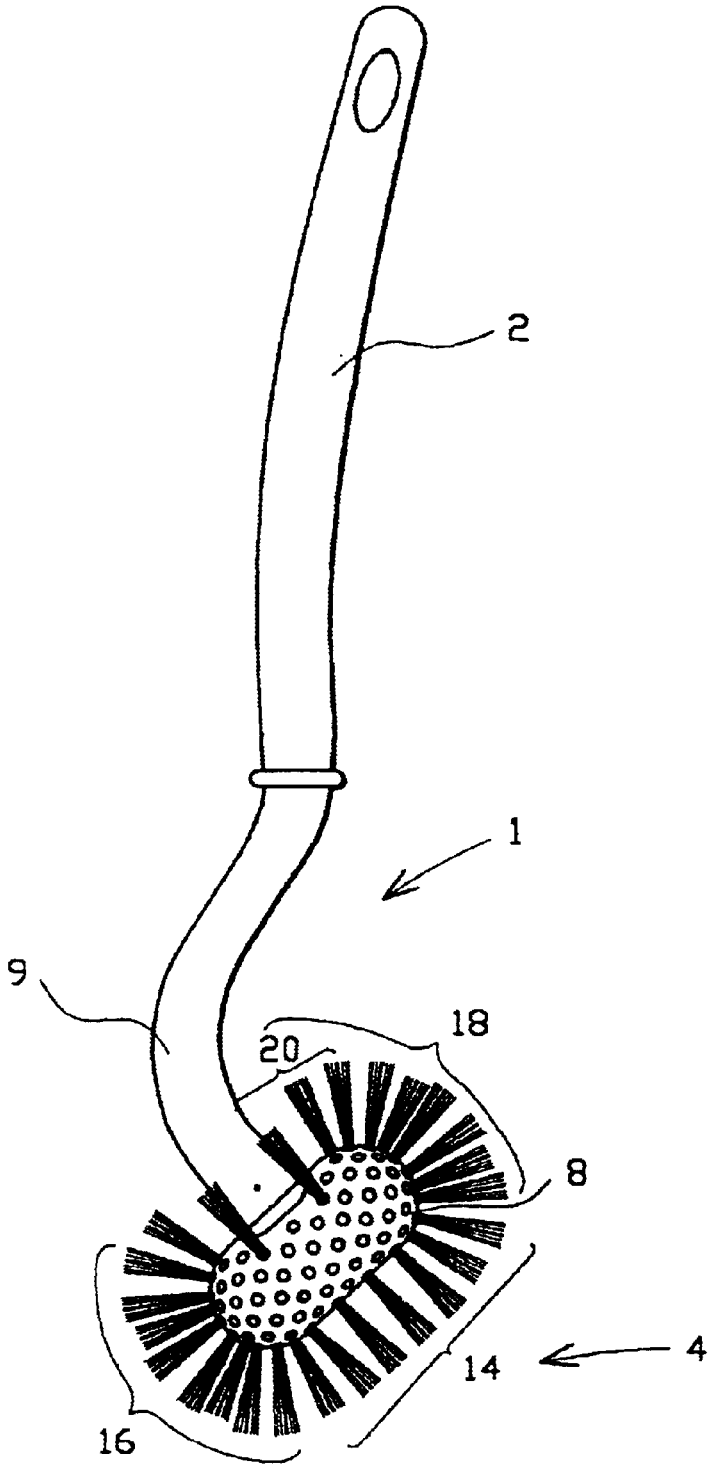
FIG. 2 is a side view of the brush as shown in FIG. 1.

A non-limiting embodiment of a toilet brush according to the present invention is shown in FIGS. 1 and 2, and generally designated as 1.

Referring to FIGS. 1 and 2, the toilet brush 1 generally includes a brush head 4 and a handle 2 extending from the brush head 4. The brush head 4 comprises a block 8 which has an elongate generally cylindrical form with curved ends of part-spherical or hemispherical shape, and a plurality of groups of bristles 6 extending from the block 8 secured in recesses 7 arranged over the block 8. It will be noted that in FIGS. 1 and 2 most of the recesses are shown, although in the finished product the bristles (many of which are removed for reasons of clarity from the drawing) extend nearly over the entire block. Extending laterally from a side of the block 8 is a spigot 10 (best seen in FIG. 3) to which the handle 2 is attached. The end of the handle 2 includes a short end portion which is provided with a recess which receives the spigot 10, a curved region 9 and a generally straight region having a portion for grasping by a user, being overall of a shape somewhat similar to a letter "j". The spigot is secured to the handle end by a pin 12.

The entire block surface is provided with bristles 6 extending therefrom with the exception of the region of the spigot 10, and a narrow region surrounding the spigot 10. The advantage of this structure is that the regions of a toilet bowl which are difficult to reach with a conventional brush can be readily reached with the present arrangement. Those bristles at a region indicated 14 in FIG. 2 will be predominantly used in cleaning the main outer vertical surfaces of the toilet bowl, whilst those bristles at the region 16 will be used in cleaning the bottom of the bowl. Those bristles at the region indicated 18 will be most used in cleaning under the rim of the bowl. In particular, those bristles at the position indicated 20 which are provided on the surface facing the handle and which extend generally parallel to the direction of the spigot towards the handle will be able to reach the outwardly facing annular surface of the rim which traditional designs are unable to reach effectively.

The manufacture of and the apparatus for manufacture of the brush is now described. The block B is formed of a unitary piece of moulded plastics material. As is conventional, the block 8 is first formed with a plurality of recesses 7, and the bristles are secured thereto by forming individual clumps of bristles which are folded into a U-shape each secured by a metal wire loop which are pushed into respective recesses at high speed and force with a pneumatically or mechanically-driven tool, as discussed further below.

Figure 3:
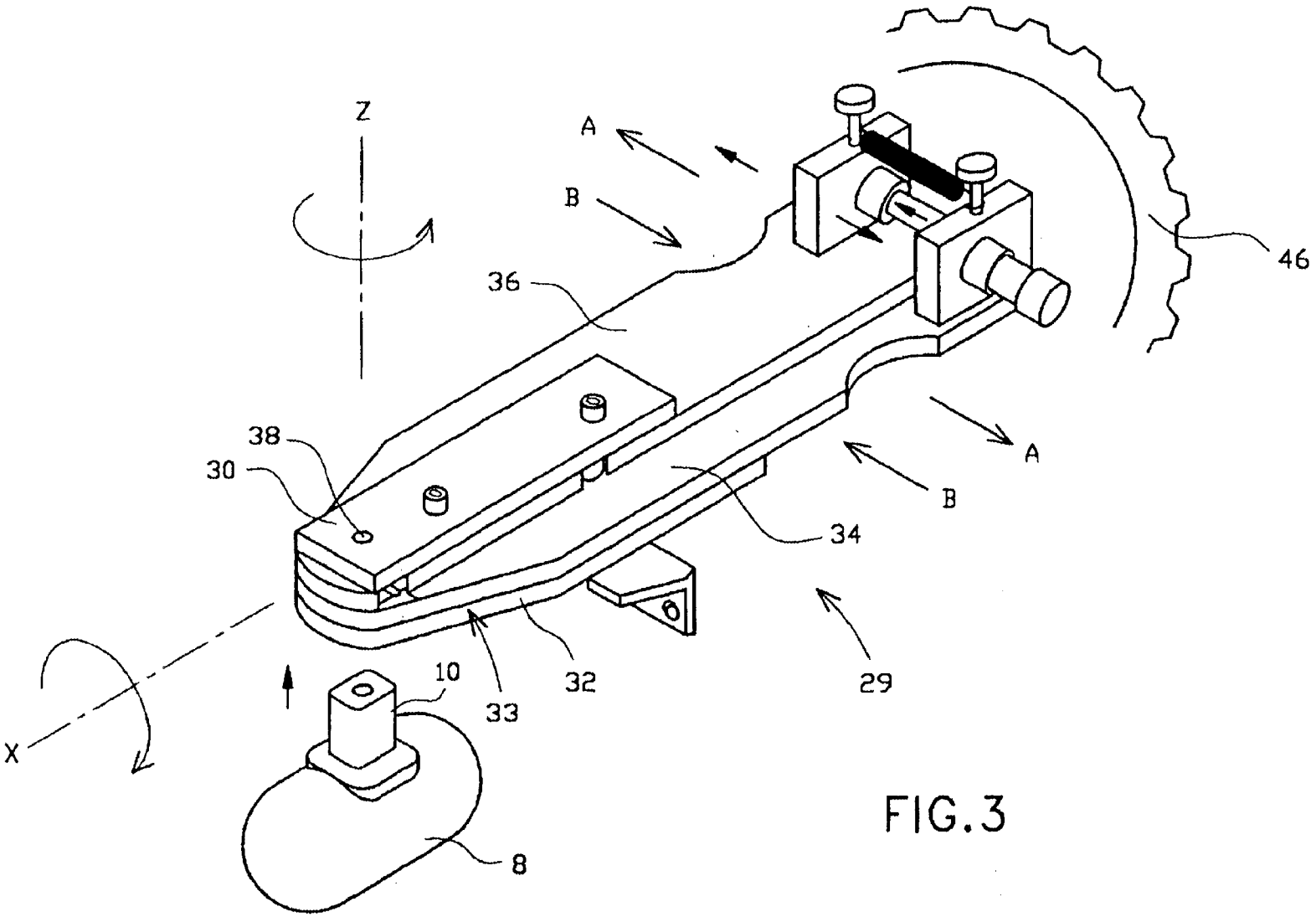
FIG. 3 shows a portion of a machine for making the brush as shown in FIG. 1.

FIG. 3 shows a clamp generally indicated 29 for holding the block 8. This comprises a fixed plates 30, 32 and a pair of movable plates 34, 36 pivotably connected at a pivot 38 and at the opposite ends acted on by a pneumatic line or lines to move the plates 34, 36 together or apart. The plates 32, 34 and 36 include rectangular cut-outs close to the pivot 38 (not visible) and dimensioned slightly greater than the spigot 10. In an open position with the plates moved apart (in the direction of the arrow A) the spigot 10 can be inserted or removed from the clamp, whilst in the closed position, with the plates moved together (in the direction of the arrow B) the spigot 10 of the block is firmly held for subsequent processing. Whilst held in the clamp 29, the shape of the clamp and in particular the angled edges indicated at 33 allow at least half of the block surface to be accessed, including those regions adjacent the spigot 10 so that bristles can be provided leaving only a small spacing between the bristles and the spigot.

The clamp 29 is mounted on a frame through gear ring 46 so as to be rotatable about an axis X generally parallel and coincident with the long axis of the block 8. The frame is also rotatable about a vertical axis Z.

Figure 4:
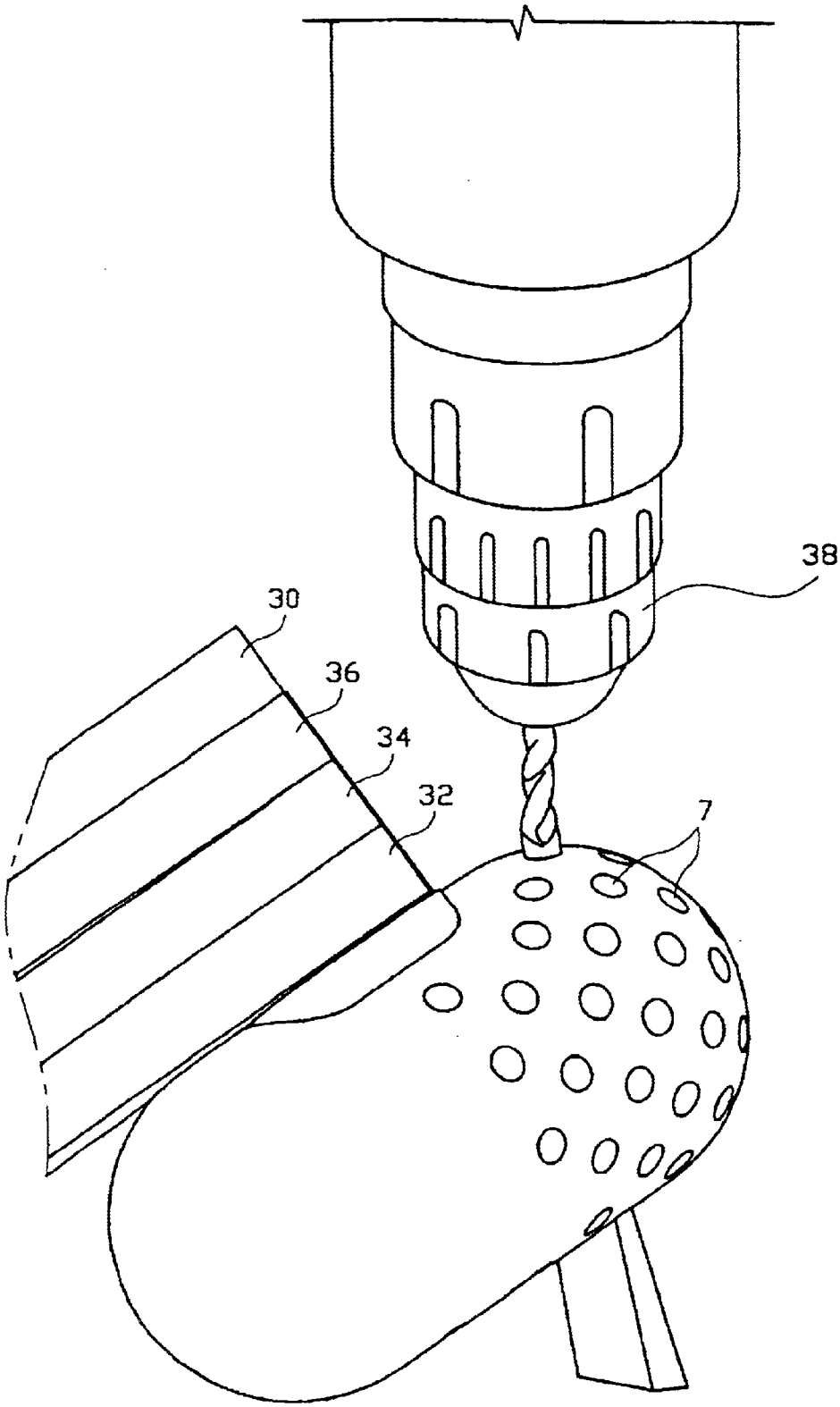
FIG. 4 shows a hole-forming step in the manufacture of the brush.
Figure 5:
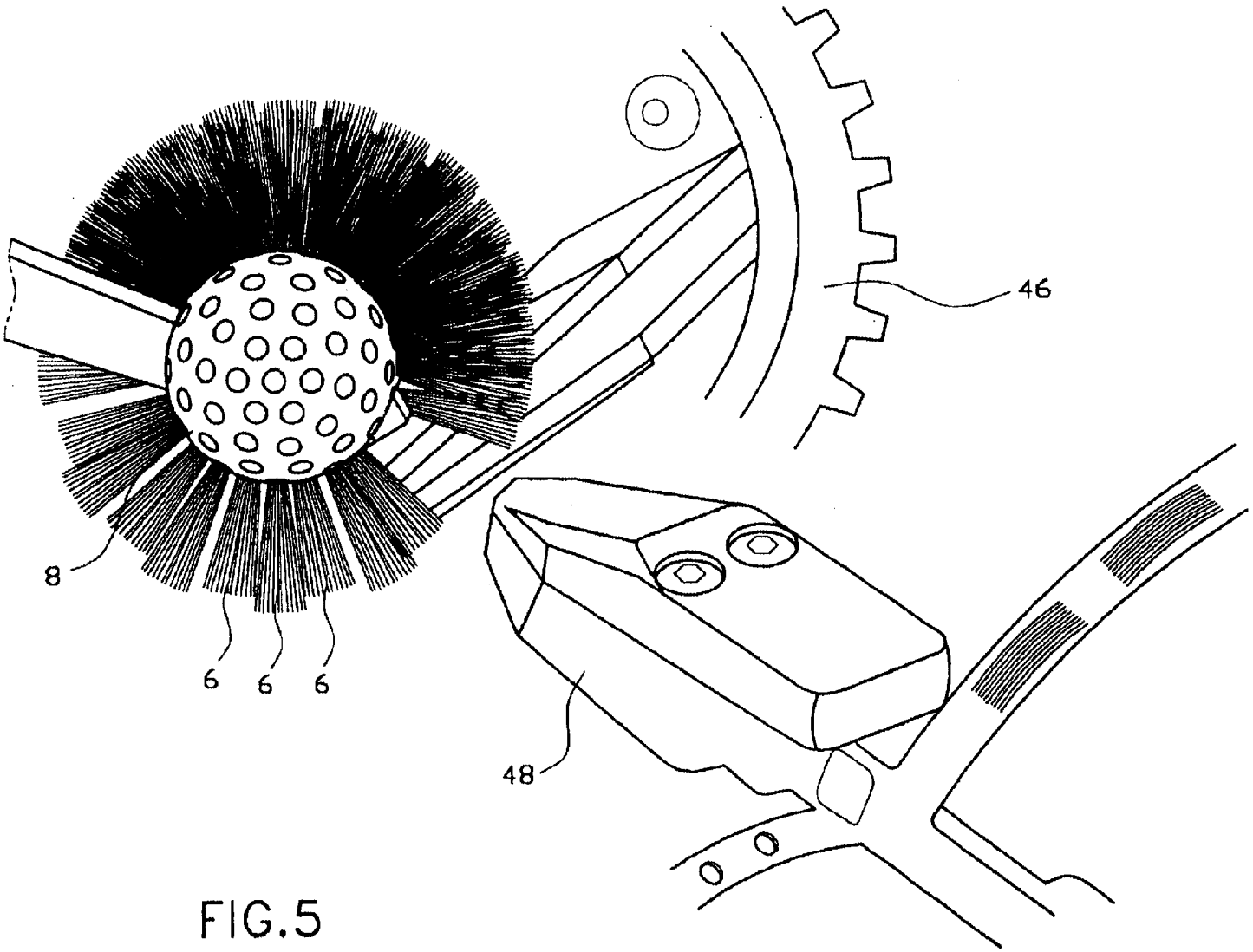
FIG. 5 shows a bristle-securing step in the manufacture of the brush.

FIG. 4 shows the drilling of the recesses 7 in the block 8. This is achieved by advancing a drill tool 38 towards the block 8 to form a recess 7, retracting the tool and rotating the clamp appropriately by a small angle so that the block 8 is appropriately aligned for the adjacent recess 7 to be drilled therein, and repeating until at least half of the recesses have been drilled therein. The movement of the clamp is preferably automatically controlled by a microcontroller or processor. The clamp 29 is then opened and block 8 removed and reversed in orientation (rotated by 180° about the spigot axis) so that the previously-inaccessible part of the block can be drilled with recesses therein.

The drilled block 8 is then provided with the bristles. A conventional gun and associated apparatus (not illustrated) includes a stripper which picks a small bundle of straight bristles from a larger bulk supply, feeds these into the tool head 48 in which a wire loop is cut from a length of wire and twisted about the bundle which is bent in half to form a U-shaped bundle. This is forced under high pressure into a recess 7. The clamp 29 is likewise rotated sequentially between each act of securing a bristle bundle. When over half the bristles have been fitted the block is removed from the clamp 29 and reversed in orientation so that the previously-inaccessible inaccessible parts of the block can be fitted with bristles.

The completed block 8 is then secured to a handle 2 by means of pin 12 pushed through the handle end and spigot 10.

What is claimed is:

1. A brush for cleaning purposes comprising:

an elongate generally cylindrical block having opposed ends, the ends of the block having a part-spherical or hemispherical shape;

a spigot extending laterally from the block intermediate the ends thereof;

a handle secured to the spigot and offset relative thereto; and a plurality of outwardly-extending bristles secured to the block and covering generally the entire surface thereof including the ends, the plurality of bristles including bristles on a region of the block surrounding the spigot which bristles extend in the direction of the spigot towards the handle.

2. A brush according to claim 1 wherein the spigot is unitarily formed with the block.

3. A brush according to claim 1 wherein the handle is formed within a recess within which the spigot is fitted.

4. A brush according to claim 3 wherein the handle is secured to the spigot by means of a pin.

* * * * *